United States Patent [19]

Furutsu

[11] Patent Number: 4,742,601

[45] Date of Patent: May 10, 1988

[54] TYING DEVICE

[75] Inventor: Akira Furutsu, Tokyo, Japan

[73] Assignee: Japan Bano'K Co., Ltd., Tokyo, Japan

[21] Appl. No.: 905,419

[22] Filed: Sep. 10, 1986

Related U.S. Application Data

[63] Continuation-in-part of Ser. No. 755,766, Jul. 17, 1985, abandoned.

[30] Foreign Application Priority Data

Aug. 13, 1984 [JP] Japan ..... 59-122856[U]
Dec. 19, 1984 [JP] Japan ..... 59-191427[U]
Dec. 19, 1984 [JP] Japan ..... 59-191428[U]

[51] Int. Cl.[4] ..... B65D 77/10
[52] U.S. Cl. ..... 24/30.5 R; 24/543
[58] Field of Search ..... 251/10; 128/346; 292/322; 24/16 PB, 30.5 R, 30.5 P, 542, 543, 557, 545, 487, 556, 559, 562

[56] References Cited

U.S. PATENT DOCUMENTS 2,074,841 3/1937 Haimowitz ..... 24/543 X
3,604,071 9/1971 Reimels ..... 128/346 X
3,621,539 11/1971 Ayers ..... 24/30.5 R
3,854,482 12/1974 Laugherty et al. ..... 292/322 X
4,061,873 12/1977 Berg, Jr. et al. ..... 24/543 X
4,220,301 9/1980 Jacobs et al. ..... 24/16 PB X
4,291,698 9/1981 Fuchs ..... 24/543 X
4,296,529 10/1981 Brown ..... 24/30.5 P
4,380,101 4/1983 Joubert et al. ..... 24/543 X
4,395,799 8/1983 Batts ..... 24/562 X
4,523,353 6/1985 Hubbard et al. ..... 24/543 X
4,536,924 8/1985 Willoughby ..... 24/543 X

*Primary Examiner*—Kenneth J. Dorner
*Assistant Examiner*—James R. Brittain
*Attorney, Agent, or Firm*—Armstrong, Nikaido, Marmelstein & Kubovcik

[57] ABSTRACT

Disclosed is a tying device for closing the mouth of a bag-type container, which comprises a first part and a second part connected to each other through a hinge portion which are integrally formed from a synthetic resin, and which is foldable at the hinge portion into two, wherein the second part is more flexible than the first part and has a pawl portion formed at the unattached end thereof, and the second part is formed at the unattached end on the bottom thereof with an engaging portion engageable with the pawl portion, and wherein the first part is provided on the bottom with a ridge.

18 Claims, 7 Drawing Sheets

TYING DEVICE

This application is a continuation-in-part of Ser. No. 755,766, filed July 17, 1985, abandoned.

BACKGROUND

The present invention relates to a tying device made of a synthetic resin for use for closing the mouth of a bag-type container or bundling linear bodies such as cables, wires and so forth.

Today, a variety of bag-type containers are widely utilized in household activities and in various stores, for example grocer's stores, which include such ones as being made of a net web and used for containing fruits, vegetables, potatoes or like foodstuffs, and ones made of a synthetic-resin film for containing various other foodstuffs for example for their storage in a refrigerator. To close the mouth of such bag-type containers, which is often required to be closed in a water-tight or an air-tight manner, generally use is made of elastics (rubber bands) or string-type ties made of a synthetic resin and having a metal wire core.

To close the mouth of a bag of the mentioned sort with use of an elastic, it is required to wind the elastic a number of turns about the intended portion in the vicinity of the mouth of the bag, while in cases of the use of a string-type tie of the above-mentioned sort it is required to apply the tie around the intended mouth portion of the bag and twist its two end portions together a number of times. Then, particularly in cases of bags containing daily-use foodstuffs, they need to be opened and re-closed frequently or each time when the foodstuff is taken out of the bag, portion by portion. If the sealing of the bag opening has been made by use of an elastic and by winding it a number of turns, not only it takes time to unwind the elastic to open the bag but also it is likely, as is often experienced in actuality, that the turns of the elastic become intertwined and hardly released, making unavoidable to destroy the elastic. In the case of the string tie above referred to, the twist once imparted to the tie or, more specifically, to its metal wire core, can hardly completely be cancelled, and after a certain number of repeated use of the tie, it becomes extremely difficult to release the effect of twist effectively for a further repeated use of the tie. Moreover, it to begin with is troublesome and inefficient to have to impart twists to the tie and remove them each time the bag is closed or re-closed with the tie.

The above indicated difficulties and inconveniences with use of elastics and string-type ties for the closing of the mouth of bags are true also in the case of bundling linear bodies.

SUMMARY

It therefore is a primary object of the present invention to provide a tying device made of a synthetic resin which can close the mouth of a bag-type container or bundle linear bodies only through a simple operation made thereof.

It is another object of the invention to provide a plastic-made tying device which can be extremely easily released from its self-locked condition in which it closes the bag's mouth or bundles linear bodies.

It is a further object of the invention to provide a plastic tying device which can be effectively used in repetition.

It is a still further object of the invention to provide a plastic tie which can exhibit remarkable sealing performance and bundling performance.

It is a yet still further object of the invention to provide a tying device which can be easily manufactured from a synthetic resin.

THE DRAWINGS

FIGS. 12 to 14 represent a second embodiment of the present invention, in which FIG. 12 shows a top plan view similar to FIG. 1, FIG. 13 shows a side elevational view of FIG. 12, and FIG. 14 is a bottom plan view of FIG. 12;

FIGS. 16 to 18 represent a third embodiment of the invention, in which FIG. 14 is a top plan view similar to FIGS. 1 and 12, FIG. 17 is a side elevational view of FIG. 16, and FIG. 18 is a bottom plan view of FIG. 16;

FIGS. 20 to 22 illustrate a tying device according to a fourth embodiment of the invention, in which FIG. 20 is a top plan view, FIG. 21 shows, partly in section, a side elevational view of FIG. 20, and FIG. 22 is a bottom plan view of FIG. 20;

THE PREFERRED EMBODIMENTS

Now, the present invention will be described in greater detail in connection with several preferred embodiments thereof illustrated in the accompanying drawings.

Figure 1:
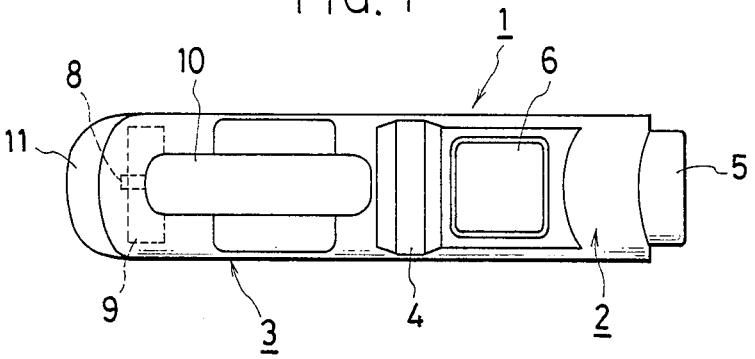
FIG. 1 shows a top plan view of a tying device according to a first embodiment of the present invention.
Figure 2:
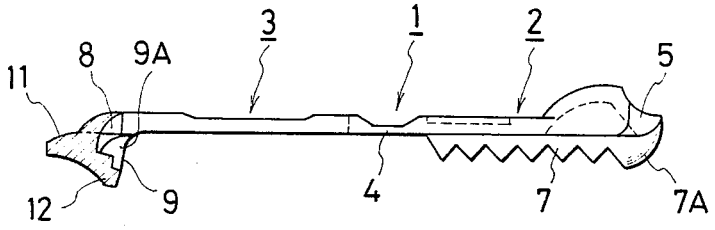
FIG. 2 shows, partly in section, a side elevational view of the tying device of FIG. 1.
Figure 3:
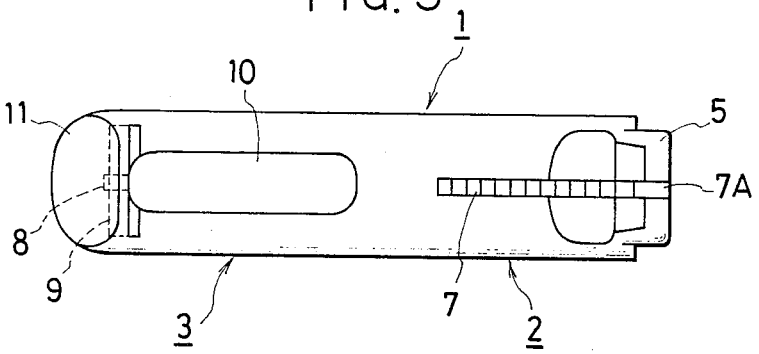
FIG. 3 is a bottom plan view of the tying device of FIG. 1.

Initially referring to FIGS. 1 to 3, which altogether represent a first embodiment of the invention, a tying device 1 is therein shown to comprise a first part 2 and a second part 3 which are integrally molded from a synthetic resin such as nylon, polypropylene or polyethylene and are foldable into two at a central hinge part 4 in a manner of one to overlie the other; in use of this tying device 1, normally it is expedient to bring the first part 2 to overlie the second part 3, and these first and second parts 2 and 3 will herein be referred to also as an upper part and a lower part, respectively.

While the hinge part 4 constituting the point of folding of the plastic tying device 1 is relatively rich in flexibility, the first part 2 is of a relatively high rigidity so that as the upper part, it can effectively exert a relatively high pressing force against an object or objects to be tied. To obtain a sufficient strength in connection with the upper part 2, this part 2 may be made having a relatively great thickness or made comprising a ribbed structure.

At the forward end away from the central hinge part 4 or the unattached end, the first part 2 is formed with a pawl portion 5 having a reduced width, and closer to the hinge part, it may be formed with an indication portion 6 to thereat apply such as a symbol and/or mark, as needs be. On the underside or rear side, the first part 2 has a ridge 7, which is formed to extend from the vicinity of the hinge part 4 up to the pawl portion 5 at the unattached end of the first part.

Figure 4:
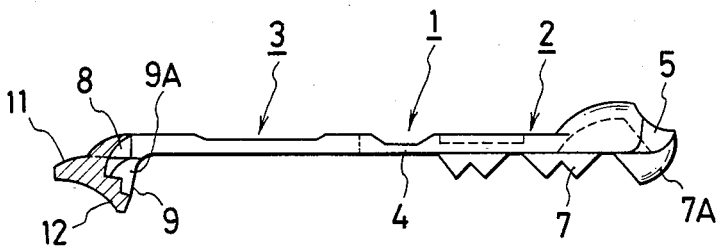
FIG. 4 is a side elevational view similar to FIG. 2, showing partly in section a modified structure of the tying device of the first embodiment.
Figure 5:
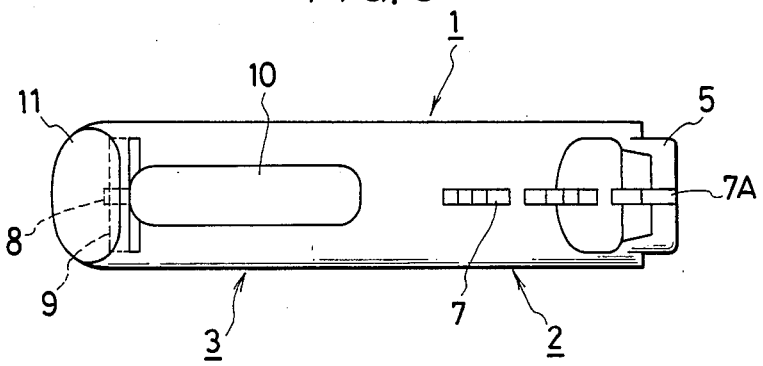
FIG. 5 is a bottom plan view of FIG. 4.
Figure 8:
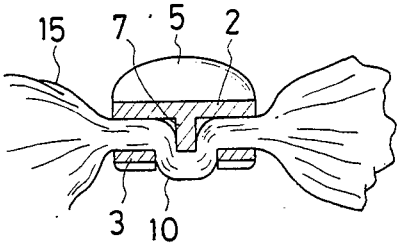
FIG. 8 shows a sectional view taken along the line Y—Y in FIG. 7.

Although it should preferably be located on a center line between side edges of the first part 2, the ridge 7 may otherwise be formed at any portion on the rear side or underside of the first part 2, providing that it can be received in a slot 10 in the second or lower part 3 as later to be described and can fix an object to be tied 15 in a manner of biting the object as shown in for example FIG. 8. No particular limitation is applicable again to the configuration of the ridge 7 insofar as it permits the ridge to cooperate with the slot 10 to stably hold the object 15 in position, but the ridge 7 should preferably have a serrate profile, in which the serrations may be continuously formed as shown in FIGS. 2 and 3 or formed at intervals as shown in FIGS. 4 and 5. Also, the ridge 7 may be provided only in a single line or in a plurality of parallel lines.

The second or lower part 3, which normally is brought to be overlaid by the first part 2 in folding the tying device, is formed to be more flexible than the first part 2. The second part 3 is formed with the above-mentioned slot 10, and on the bottom or underside at the unattached or forward end portion away from the hinge portion 4, has an engaging portion 9 which, in the first embodiment under consideration, comprises a pocket or cavity having side walls 9A in which the pawl portion 5 of the first part 2 is received and releasably locked.

The slot 10 may be formed in any optional portion of the second part 3 insofar as it can receive the ridge 7 therein as before stated, but preferably it should be provided at a central portion of the second part 3. Providing it can securely fix the object to be tied 15 in position in cooperation with the ridge 7, the slot 10 is not necessarily required to be capable of therein receiving the entire of the ridge 7, but it should preferably be so formed as to be able to receive the whole of the ridge 7.

The engaging portion 9 is provided with a handle portion 11 forwardly projected from this portion 9, which is operated in releasing the locked condition of the pawl portion 5 in the pocket portion 9. It is possible to provide a guide groove 8 in a central portion in the engaging part 9 and provide a guide pawl 7A at the forward end of the serrated ridge 7 so that in pressing the pawl portion 5 into the engaging portion 9, the guide pawl 7A can be guided in the guide groove 8 and can function as guide means in pressing the pawl portion 5 into the engaging portion 9.

Preferably, the guide pawl 7A should be designed in a dimensional and positional specification such that this guide pawl 7A can touch the upper edge of the engaging portion 9 before the condition is met in which the pawl portion 5 is locked in the engaging portion 9.

By providing the guide groove 8 in the engaging portion 9 as described above, in a locked condition of the device 1 the first portion 2 can be effectively prevented from becoming displaced in a lateral or transverse direction of the device, so that the object 15 once tied will not become released even if a great force is applied thereto.

The basic technical concept of the present invention and accordingly the basic arrangement of the tying device 1 according to the invention reside in that by applying the first part 2 of the device 1 at the intended portion of the object 15 for example a bag-type container, for example from above the object, and by supporting the corresponding underside portion of the object by the second part 3 which has a more or less greater flexibility than the first part 2, from below the object, the pawl portion 5 at the forward or unattached end of the upper located first portion 2 is fitted into and engaged in the engaging pocket portion 9 at the forward or unattached end of the lower located second portion 3 to accomplish tying of the object 5.

In order for the device 1 to be functional as above, the pawl portion 5 is so molded as to be relatively highly rigid, and this pawl portion 5 and the engaging portion 9 are structured such that the former can be smoothly guided into the latter without a lateral displacement of the former relative to the latter. Also, the side walls 9A function to prevent any portion of the object to be tied from becoming caught into the pocket or cavity of the engaging portion 9.

According to the present invention, the tying device 1 is also required to be easily released from its locked condition. To this end, the second part 3 is formed to be flexed relatively with ease so that the engaging portion 9 having a V-letter shape in a longitudinal section of the device 1 can be rocked with ease; at the same time, the handle portion 11 is preferably provided at the forward end of the engaging portion 9 away from the hinge part 4 to facilitate the operation for rocking the engaging portion.

Further, with the tying device 1 of the first embodiment of the invention under consideration, the ridge 7 provided in a central portion on the bottom of the first part 2, up to the forward end thereof away from the hinge part 4, is located so that in a folded-over condition of the device 1, the whole of the ridge 7 can enter the slot 10 in the second part 3, and it functions to bend a portion of the object to be tied and press the bent portion of the object into the slot 10. The ridge 7 has an irregular or convex-concave edge line like serrations to prevent slipping of the object.

Figure 6:
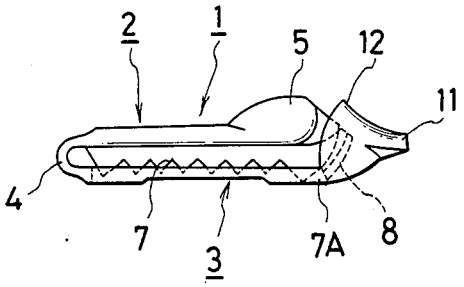
FIG. 6 is a side elevational view, showing the device of FIG. 1 in a double-folded and self-locked condition.
Figure 7:
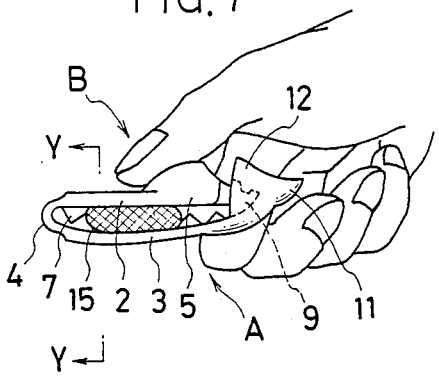
FIG. 7 is a side elevational view, taken for illustration of an object tying-operation with use of the device of the first embodiment.

FIG. 6 shows the condition in which the tying device 1 is folded over at the hinge portion 4 and the pawl portion 5 is locked in the cavity in the engaging portion 9. In carrying out a tying operation with use of the device 1, the object to be tied 15 is placed between the first and the second parts 2 and 3 which are partly folded over by operator's fingers, and in that condition, the parts 2 and 3 are brought to come closer to each other in the directions of arrows A and B as shown in FIG. 7, to eventually have the pawl portion 5 received in the engaging portion 9. During the above operation, a portion of the object 15 is pressed by the ridge 7 on the underside of the upper part 2 into the slot 10 in the lower part 3 as shown in FIG. 8, and as best seen from FIGS. 7 and 9, the lower or second part 3 which is relatively highly flexible undergoes flexing, so that the engaging part 9 of the lower part 3 is moved towards the side of the pawl portion 5, whereby an engaging tooth 12 formed in the engaging portion 9 can firmly engage the pawl portion 5 along a forward end edge portion thereof to rigidly tie the object 15.

Figure 10:
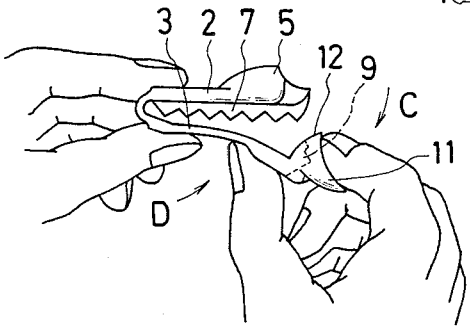
FIG. 10 shows in side elevation the manner in which releasing of the lock made of the device of the first embodiment is operated.

Then, to release the locked condition of the device 1, as shown in FIG. 10 it will be operated to support the underside of the lower part 3 with a thumb and place an index finger on the handle portion 11, and rock the handle portion 11 in the direction of an arrow C, while bending the lower part 3 in the direction of an arrow D, whereby the engaging tooth 12 will with ease be disengaged from the pawl portion 5.

Figure 9:
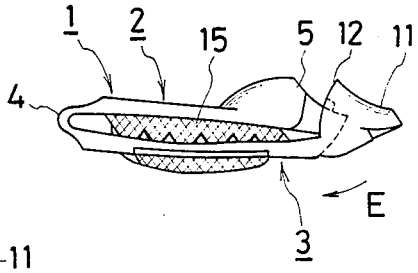
FIG. 9 is a side elevational view, taken to show a final condition in use of the tying device of the first embodiment.
Figure 11:
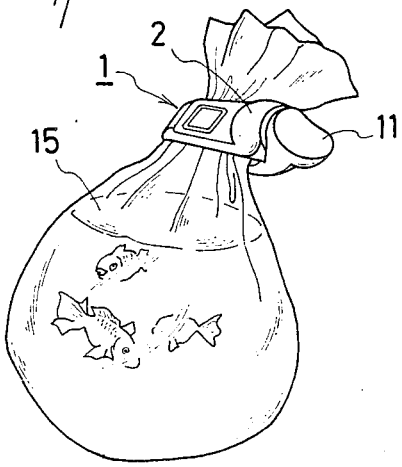
FIG. 11 is a view, showing an example of the usage of the tying device of the first embodiment.

FIG. 11 shows an instance of use of the tying device 1, and in this instance, the device 1 is applied about a portion in the vicinity of the mouth of a plastic film bag, and its pawl portion 5 is lockably engaged in the engaging portion 9 as shown in FIG. 9.

Figure 12:
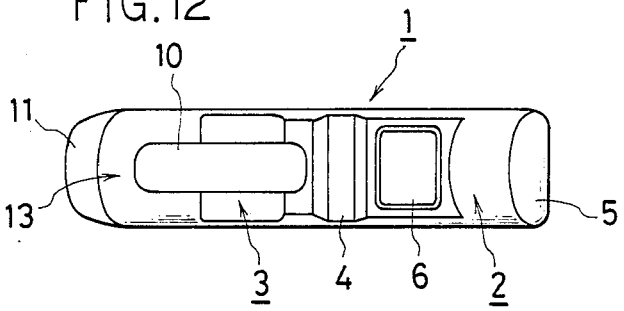
Figure 13:
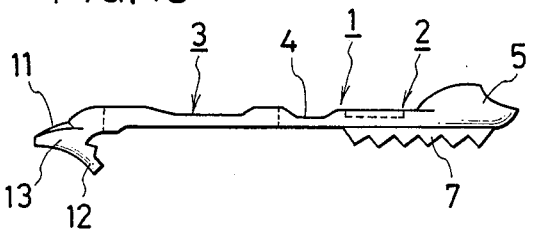
Figure 14:
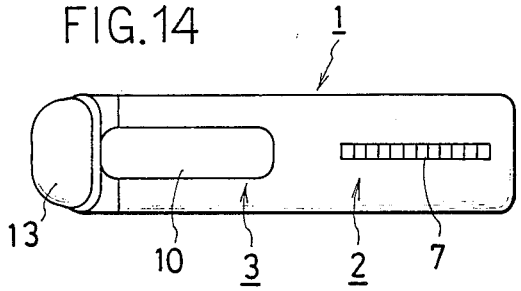

In the second embodiment of the invention illustrated in FIGS. 12 to 15, the tying device 1 has at the unattached forward end on the front side face of the first part 2 a pawl portion 5 which is not reduced in the width but has a same width as the first part 2 as shown in FIG. 12, and has in a central portion on the rear side or bottom of the first part 2 a ridge 7 which is not extended up to the location of the pawl portion 5 as shown in FIG. 13. Also, the second part 3 is provided at the forward end on its rear side with an engaging portion 13 of a hook-like structure.

According to the before described first embodiment of the invention, the first part 2 is provided with the pawl portion 5 and the guide pawl 7A connected to the pawl portion 5, while the second part 3 is provided with an engaging portion 9 having a cavity or pocket having side walls 9A into which the pawl portion 5 is inserted, and the arrangement is such that the guide pawl 7A is received in the engaging portion 9 to lock the device 1.

Figure 15:
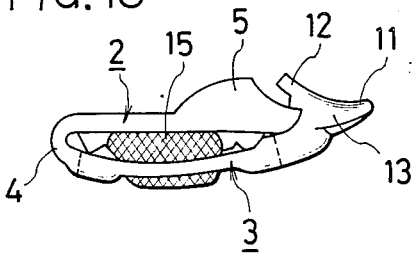
FIG. 15 is a side elevational view, showing a final condition in use of the device of the second embodiment.
Figure 16:
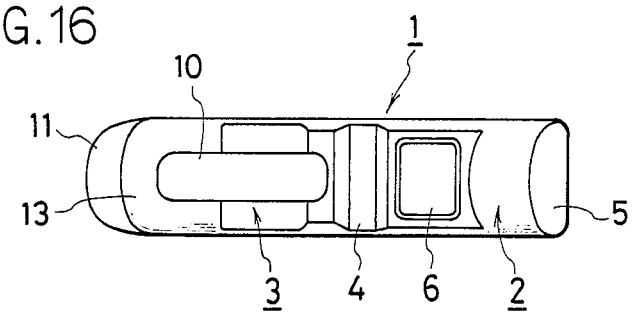
Figure 17:
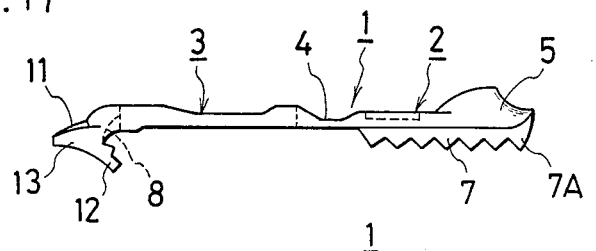
Figure 18:
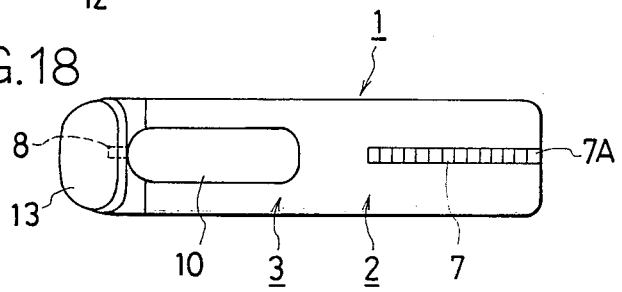
Figure 19:
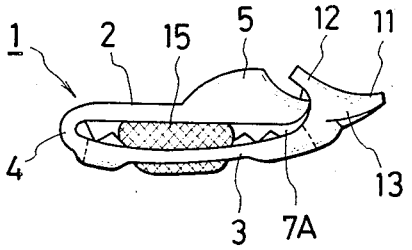
FIG. 19 is a side elevational view, showing a final condition in use of the device of the third embodiment.

According to the present second embodiment, the engaging portion 13 is not of the type having a cavity or pocket having side walls 9A, nor a guide pawl such as the one indicated by 7A in the first embodiment is provided, and as shown in FIG. 15, the pawl portion 5 is engaged with the engaging teeth 12 in the engaging portion 13.

FIGS. 16 to 19 altogether represent a third embodiment of the invention, and in the present embodiment, the guide pawl 7A is provided at the forward end of the ridge 7 away from the hinge part 4 and in continuation to the pawl portion 5 having a same width as the first part 2. The engaging portion 13 of the second part 3 is provided with a guide groove 8. The locking arrangement of the tying device 1 of this embodiment is such that the pawl portion 5 is engaged with the engaging tooth 12 and, at the same time, the guide pawl 7A is guided and received in the guide groove 8.

In the before described first embodiment, the pawl portion 5 is of a width smaller than the width of the first part 2 (FIG. 1) and is received in the cavity or recess in the engaging portion (FIG. 9). In contrast to this, in the present third embodiment, the pawl portion 5 has a same width as the first part 2, and instead of the pawl portion 5 being received in a cavity or recess, the guide pawl 7A is received in the guide groove 8 in the locked condition of the pawl portion 5 with the engaging tooth 12.

Figure 20:
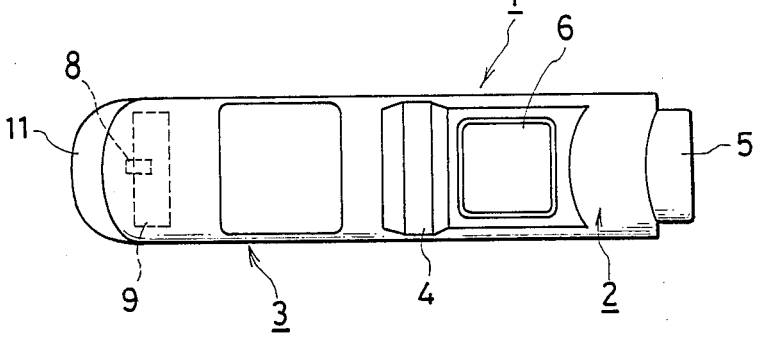
Figure 21:
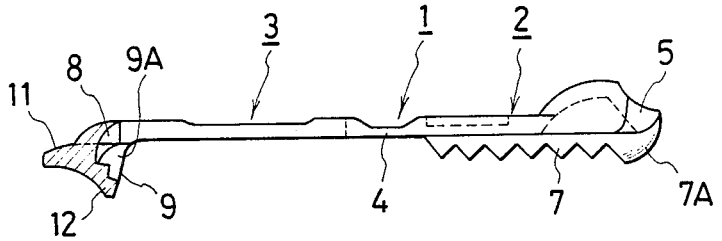
Figure 22:
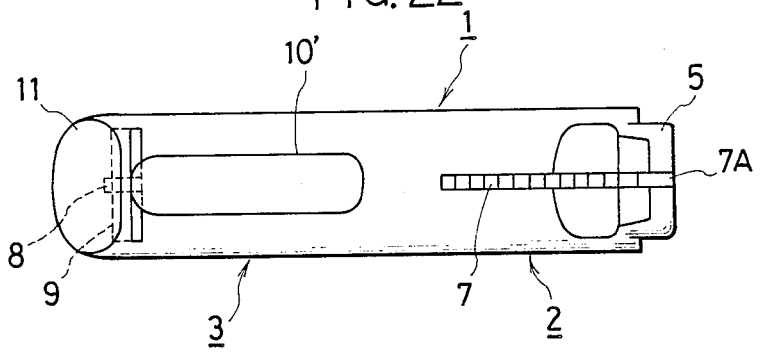

FIGS. 20 to 22 altogether show a tying device 1 according to a fourth embodiment of the invention, which differs from the tying device of the first embodiment in that it does not have the slot 10 in the second part 3, and except for this point, what was described in connection with the first embodiment applies to this fourth embodiment.

With the tying device 1 of the present fourth embodiment, which is devoid of the slot 10 in the second part 3, an object to be tied 15 is tied between the underside of the second part 3 and the ridge 7 on the first part 2, therefore the function to hold the object 15 in position is more or less lowered in comparison to the case of the above described first to third embodiments in each of which the slot 10 is provided in the second part 3.

However, since the second part 3 is more flexible than the first part 2, the device of the fourth embodiment can still exhibit a remarkable power to prevent a tied object 15 from being released, and in order to enhance the object tying power, it is feasible to provide a concavity 10' as shown in FIG. 22.

Figure 23:
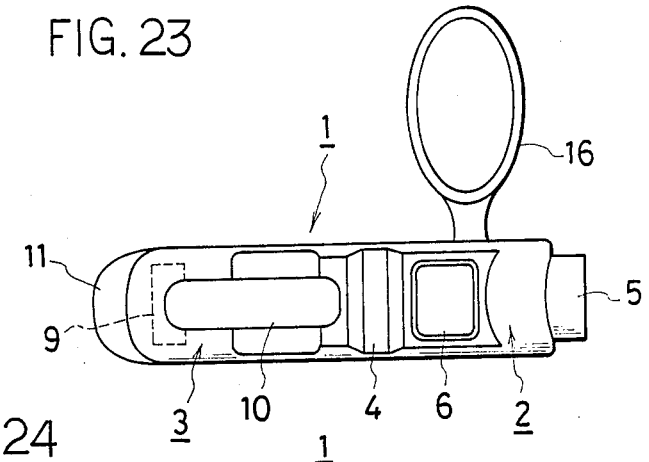
FIG. 23 shows a top plan view, illustrating a fifth embodiment of the invention.
Figure 25:
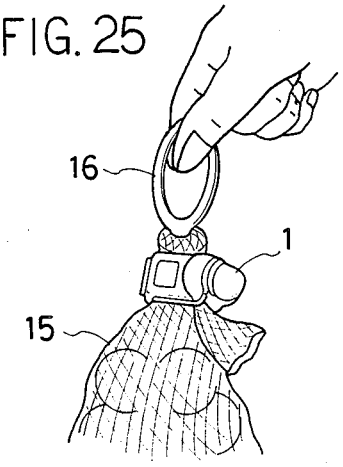
FIG. 25 is a perspective view, showing an example of the usage of the tying device of the sixth embodiment.

FIG. 23 shows a tying device 1 according to a fifth embodiment of the invention, in which a suspension ring 16 is provided at a side of the first part 2. The device 1 of this embodiment is used in a manner for example as shown in FIG. 25, in which the device is applied to close the mouth of a net-type bag, an object to be tied 15.

Figure 24:
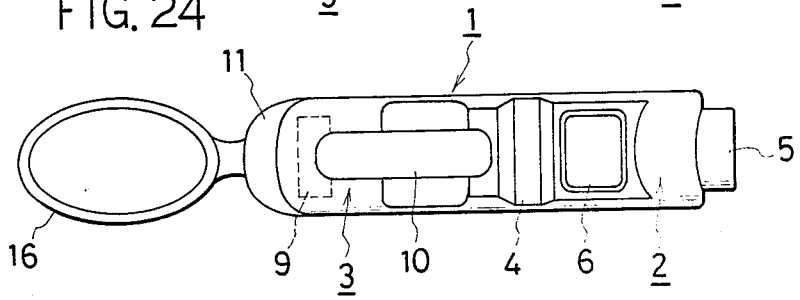
FIG. 24 is a top plan view, showing a sixth embodiment of the invention.
Figure 26:
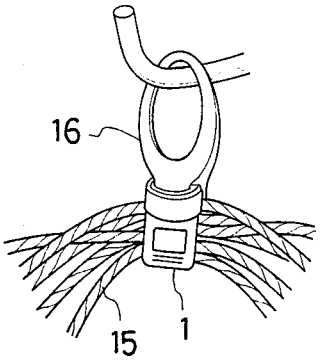
FIG. 26 is a perspective view, showing another example of the usage of the tying device of the sixth embodiment.

FIG. 24 shows a tying device 1 of a sixth embodiment of the invention, in which a suspension ring 16 is provided at the unattached forward end of the handle portion 11 away from the hinge part 4, in a manner of extending in the axial direction of the device 1. FIG. 26 shows an example of the usage of the device of this sixth embodiment.

As described in detail in the foregoing, when an object to be tied 15 is once held between the first or upper part 2 and the second or lower part 3 of the tying device 1 according to the present invention as shown in FIGS. 7 and 9, the lower part 3 undergoes flexing, depicting a curve generally following the lower edge contour of the object 15, so that the engaging portion 9 is effectively moved in the direction of an arrow E in FIG. 9, towards the side of the pawl portion 5 to become stably engaged with the pawl portion. As the object to be tied 15 is thicker, the engaging portion 9 is moved closer to the pawl portion 5 and more strongly engaged with the pawl portion 5.

In releasing the self-locked condition of the tying device 1, the handle portion 11 is rocked and the lower part 3 is flexed downwardly as shown in FIG. 10, simply whereby the engaging tooth 12 can be readily disengaged from the pawl portion 5.

With the tying device 1 according to the invention, further, the object to be tied 15 is partly pressed into the slot 10 in the upper part 2 by the ridge 7 formed on the rear side or underside of the lower part 3, so that it is almost completely prevented from being displaced in a lateral or transverse direction of the device 1.

Particularly with the device 1 according to the first embodiment of the invention, the pawl portion 5 of a reduced width is received in a cavity of the engaging portion 9, so that it is obviated that the object to be tied 15 becomes accidentally caught in the recess in the engaging portion 9, the object 15 being stopped at edges of side walls 9A. Also, the ridge 7 being provided up to the unattached outer end of the first part 2 either continuously or at intervals, it can be performed that in a condition where the intended object 15 is held between the first and the second parts 2 and 3, the object 15 is smoothly moved towards the side of the hinge portion 4 simply by lightly pulling the object 15, whereby the object 15 can be stably fixed in position without any portion thereof protruding out of the outer end of the first part 2 and/or the engaging tooth 12. In addition, the ridge 7 is in its entirety received in the slot 10, so that in closing the mouth of a bag-type object to be tied 15, a complete sealing of the opening of the object can be effected.

It will be readily appreciated that it is feasible to set the length of the first part 2 or the second part 3 such that in a condition of the tying device 1 folded over without an object 15 held between the first and the second parts 2 and 3 thereof as shown in FIG. 6, an appreciable gap is produced between the pawl portion 5 and the engaging tooth 12. With a so structured device 1, the flexible second part 3 can undergo flexing to a larger extent and an object 15 of an accordingly larger size or mass can therefore be effectively tied.

It will also be appreciated with ease that the tying device 1 according to each of the described embodiments of the invention can be used in repetition and is highly useful in closing the mouth of bag-type containers used in storing foodstuffs in a refrigerator or in transporting foodstuffs.

I claim:

1. A tying device comprising a first part and a second part, each having an essentially rectangular plan view integrally molded from a synthetic resin and joined at a foldable hinge part, said first part being relatively inflexible, having at least one ridge projecting from a planar surface thereof, and terminating, at its unattached end, in a rigid pawl portion projecting from the planar surface opposite said surface from which said ridge projects, said pawl portion having a width less than the width of said first part and being provided, at the unattached end thereof, with a guide pawl in continuation of said pawl portion, said second part being relatively flexible and terminating, at its unattached end, in an engaging portion projecting from the planar surface which is a continuation of said surface from which said ridge projects and which comprises a cavity formed with a guide groove for receiving said guide pawl of said pawl portion of said first part; said hinge part consisting of a thinned portion of molded resin extending across the surface of the device perpendicular to the length of the device at a location which allows the ridge bearing surface of the first part and the continuation surface of the second part to be brought into opposition to each other so that the pawl portion of said first part can be engaged in the engaging portion of said second part.

2. A tying device as claimed in claim 1, wherein said second part is provided with a slot capable of receiving said ridge of said first part.

3. A tying device as claimed in claim 1, wherein said second part is provided with a concavity in a portion on the bottom thereof corresponding to said ridge.

4. A tying device as claimed in claim 3, wherein said concavity is formed in said second part, along the longitudinal axis of the device.

5. A tying device as claimed in claim 1, wherein said first part has a suspension ring provided at a side portion thereof.

6. A tying device as claimed in claim 1, wherein said second part has a suspension ring provided at the unattached end thereof.

7. A tying device as claimed in claim 1, wherein said ridge is formed in a central portion on the bottom of said first part, extending along the longitudinal axis of the device and said slot is formed on said second part, along the longitudinal axis of the device.

8. A tying device as claimed in claim 1, wherein said ridge comprises a plurality of serrations.

9. A tying device as claimed in claim 1, wherein said engaging portion is provided at the unattached end thereof with a handle portion to be operated in releasing a locking engagement between said pawl portion and said engaging portion.

10. A tying device comprising a first part and a second part, each having an essentially rectangular plan view integrally molded from a synthetic resin and joined at a foldable hinge part, said first part being relatively inflexible, having at least one ridge projecting from a planar surface thereof, and terminating, at its unattached end, in a rigid pawl portion projecting from the planar surface opposite said surface from which ridge projects, wherein said pawl portion has a substantially identical width as said first part and is formed at the unattached end on the bottom thereof, with a guide pawl in continuation of said pawl portion; said second part being relatively flexible and termianting, at its unattached end, in an engaging portion projecting from the planar surface which is a continuation of said surface from which said ridge projects, said engaging portion being provided with a guide groove for receiving said guide pawl of said pawl portion of said first part; said hinge part consisting of a thinned portion of molded resin extending across the surface of the device perpendicular to the length of the device at a location which allows the ridge bearing surface of the first part and the continuation surface of the second part to be brought into opposite to each other so that the pawl portion of said first part can be engaged in the engaging portion of said second part.

11. A tying device according to claim 10, wherein said second part is provided with a slot capable of receiving said ridge of said first part.

12. A tying device according to claim 10, wherein said second part is provided with a concavity in a portion on the bottom thereof corresponding to said ridge.

13. A tying device according to claim 12, wherein said concavity is formed in said second part along the longitudinal axis of the device.

14. A tying device according to claim 10, wherein said ridge comprises a plurality of serrations.

15. A tying device according to claim 10, wherein a suspension ring is provided on a side portion of said first part.

16. A tying device according to claim 10, wherein said second part has a suspension ring is provided at the unattached end thereof.

17. A tying device according to claim 10, wherein said ridge is formed in a central portion on the bottom of said first part, extending along the longitudinal axis of the device and wherein said slot is formed in said second part along the longitudinal axis of the device.

18. A tying device according to claim 10, wherein said engaging portion is provided at the unattached end thereof with a handle portion to be operable in releasing a locking engagement between said pawl portion and said engaging portion.

* * * * *